United States Patent [19]

Lieberman

[11] Patent Number: 4,907,509

[45] Date of Patent: Mar. 13, 1990

[54] BONFIRE-SAFE LOW-VOLTAGE DETONATOR

[75] Inventor: Morton L. Lieberman, Albuquerque, N. Mex.

[73] Assignee: The United States of America as represented by the United States Department of Energy, Washington, D.C.

[21] Appl. No.: 214,369

[22] Filed: Jul. 1, 1988

[51] Int. Cl.[4] ..... F42B 3/18; F42B 3/10

[52] U.S. Cl. ..... 102/202.1; 102/202.5

[58] Field of Search ..... 102/202.1, 202.5, 202.7, 102/202.8, 202.14, 204, 205

[56] References Cited

U.S. PATENT DOCUMENTS

| | | | |
|---|---|---|---|
| 2,237,932 | 4/1941 | Handforth et al. | 102/202.5 |
| 3,035,474 | 5/1962 | LaBash, Jr. et al. | 102/202.5 |
| 3,186,341 | 6/1965 | Bjorklund et al. | 102/86.5 |
| 3,208,379 | 9/1965 | McKee et al. | 102/28 |
| 3,257,946 | 6/1966 | Tognola | 102/28 |
| 3,264,988 | 8/1966 | Rucker | 102/28 |
| 3,277,824 | 10/1966 | Bankston | 102/28 |
| 3,286,628 | 11/1966 | Young et al. | 102/202.5 |
| 3,324,793 | 6/1967 | Thomas | 102/28 |
| 3,618,523 | 11/1971 | Stresau et al. | 102/202.5 |
| 3,726,217 | 4/1973 | Dedman et al. | 102/28 R |
| 4,517,895 | 5/1985 | Rucker | 102/202.2 |

*Primary Examiner*—Charles T. Jordan

*Attorney, Agent, or Firm*—Armand McMillan; James H. Chafin; William R. Moser

[57] ABSTRACT

A column of explosive in a low-voltage detonator which makes it bonfire-safe includes a first layer of an explosive charge of CP, or a primary explosive, and a second layer of a secondary organic explosive charge, such as PETN, which has a degradation temperature lower than the autoignition temperature of the CP or primary explosives. The first layer is composed of a pair of increments disposed in a bore of a housing of the detonator in an ignition region of the explosive column and adjacent to and in contact with an electrical ignition device at one end of the bore. The second layer is composed of a plurality of increments disposed in the housing bore in a transition region of the explosive column next to and in contact with the first layer on a side opposite from the ignition device. The first layer is loaded under a sufficient high pressure, 25 to 40 kpsi, to achieve ignition, whereas the second layer is loaded under a sufficient low pressure, about 10 kpsi, to allow occurrence of DDT. Each increment of the first and second layers has an axial length-to-diameter ratio of one-half.

9 Claims, 1 Drawing Sheet

BONFIRE-SAFE LOW-VOLTAGE DETONATOR

RIGHTS TO INVENTION

The U.S. Government has rights in this invention pursuant to Contract No. DE-AC04-76DP00789 between the U.S. Department of Energy and AT&T Technologies, Inc.

CROSS REFERENCE TO RELATED APPLICATION

Reference is hereby made to the following copending application dealing with related subject matter and assigned to the assignee of the present invention: "Spark-Safe Low-Voltage Detonator" by Morton L. Lieberman, assigned U.S. Ser. No. 214,370 and filed on July 1, 1988.

BACKGROUND OF THE INVENTION

1. Field of the Invention

The present invention relates generally to explosive detonators and, more particularly, is concerned with a low-voltage detonator providing improved bonfire safety.

b 2. Description of the Prior Art

Reliable low-voltage detonators are typically loaded either with primary explosives, commonly lead azide and/or lead styphnate, or more recently with CP (2-(5-cyanotetrazolato) pentaamminecobalt (III) perchlorate) because it provides some safety advantages over the previously-used primary explosives. However, detonators containing CP or primary explosives adjacent to an electrical ignition device, such as bridgewire, lack intrinsic spark safety. A human-body-equivalent electrostatic discharge between a pin and the electrically-isolated housing of the detonator is sufficient to ignite the energetic material and yield a detonation output.

As a result, such detonators lack intrinsic electrostatic discharge protection and so external design features such as spark gaps, varistors, or electrostatic shunt mixes must be incorporated. In addition, CP and primary explosives readily autoignite. Consequently, detonators that contain these materials commonly yield detonation output when heated rapidly, as in a bonfire scenario.

Various attempts have been made to develop a spark-safe, low-voltage detonator by loading the detonator with an organic, secondary explosive, such as PETN (pentaerythritol tetranitrate), HMX (cyclotetramethylenetetranitramine), or RDX (cyclotrimethylene trinitramine). Such materials should provide intrinsic electrostatic discharge protection.

However, detonators using such materials have proved to be unreliable. Unlike CP, these powders frequently decouple from the bridgewire, resulting in ignition failure. Further, detonators that contain HMX, RDX, PETN, or other secondary explosives are prone to ignition and growth-to-detonation failures because powder confinement is a critical and sensitive parameter.

Studies have shown that mechanical confinement of the powder is necessary to prevent the decoupling that occurs with increasing time or thermal cycling. Elimination of the decoupling by mechanical means has not been proven to date. In addition, growth-to-detonation in such devices is sensitive to physical characteristics of the powder (particle size, surface area) and occurs more gradually than in CP detonators. As a result, reliability of growth-to-detonation is diminished.

Consequently, a need exists for a fresh approach to providing a spark-safe and bonfire-safe, low-voltage detonator that will avoid the above-described problems associated with previous attempts.

SUMMARY OF THE INVENTION

The present invention provides a bonfire-safe low-voltage detonator designed to satisfy the aforementioned needs. The invention of the patent application cross-referenced above provides a spark-safe low-voltage detonator. The compositions of the bonfire-safe detonator disclosed herein and of the spark-safe detonator disclosed in the cross-referenced application are useful separately from one another. On the other hand, it should be understood that they can also be incorporated into one detonator where the benefits of both spark and bonfire safety are desired.

The detonator of the present invention incorporates the advantages of CP and PETN, while eliminating their respective disadvantages, to yield a reliable, low-voltage detonator with improved bonfire safety. Particularly, charges of CP and PETN are loaded respectively in the ignition and transition regions of the explosive column. By having CP on the bridgewire of the ignition device, reliable ignition can be obtained. The brisance of the deflagrating CP is sufficient to yield reliable deflagration-to-detonation transition (DDT) in a sufficiently porous PETN column. As a result, a reliable detonator will be available for intended functions.

Such a selection and layering of explosive materials, however, also takes advantage of the differences in thermal stability of the two materials. Whereas CP autoignites at approximately 280 degrees C, PETN melts at 140 degrees C, resulting in degradation of the solid explosive column. Consequently, rapid heating of the detonator, as in a bonfire, should result in degradation of the PETN powder and/or detonator prior to autoignition of the CP. Given this scenario, a detonation output will not occur.

The advantages of layering may be applicable to primary explosives, rather than CP, that have autoignition temperatures much higher than the degradation temperature for the PETN powder. Thus, detonators containing lead axide or lead styphnate, for example, on the bridgewire and followed by PETN may also provide bonfire safety.

Accordingly, the present invention is set forth in a detonator having a housing with an bore therein and a header supported by the housing and mounting an electrical ignition device in communication with and adjacent to an end of the housing bore. The present invention relates to a column of explosive comprising: (a) a first layer of an explosive charge of CP disposed in the housing bore in an ignition region of the explosive column adjacent to and in contact with the ignition device; and (b) a second layer of a secondary organic explosive charge disposed in the housing bore in a transition region of the explosive column and on a side of the first layer opposite from the ignition device and in contact with the first layer. The organic explosive charge of the second layer, such as PETN, has a degradation temperature which is lower than an autoignition temperature of the CP explosive charge of the first layer.

More particularly, the first layer is loaded under a pressure of from 25 to 40 kpsi, whereas the second layer is loaded under a pressure of about 10 kpsi. Further, the first and second layers are loaded in increments having an axial length-to-diameter ratio of one-half. Specifically, the first layer is loaded in a pair of increments, whereas the second layer is loaded in more than a pair of increments. Alternatively, the first layer can be composed of an explosive charge of a primary explosive. The primary explosive of the first layer can be lead azide or lead styphnate. These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 2:
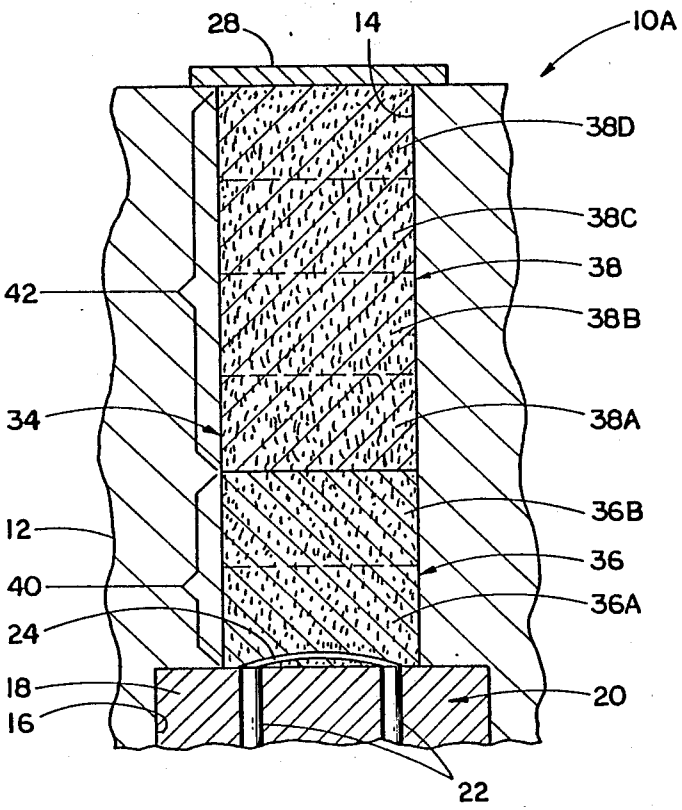
FIG. 2 is an enlarged fragmentary schematic axial sectional view of a bonfire-safe low-voltage detonator constructed in accordance with the principles of the present invention.

In the following description, like reference characters designate like or corresponding parts throughout the several views. Also in the following description, it is to be understood that such terms as "forward", "rearward", "left", "right", "upper", "lower", and the like, are words of convenience and are not to be construed as limiting terms.

Prior Art Detonator

Figure 1:
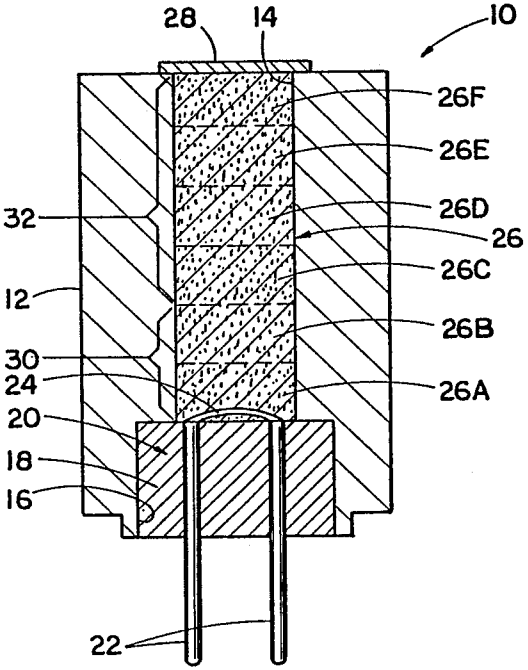
FIG. 1 PRIOR ART
FIG. 1 is a schematic axial sectional view of a standard prior art CP-loaded detonator.

Referring now to the drawings, and particularly to FIG. 1, there is schematically shown a standard prior art CP-loaded detonator, generally designated by the numeral 10. In its basic components, the detonator 10 includes a housing 12 having an axial cylindrical cavity or bore 14 open at both ends and a cylindrical recess 16 larger in diameter than and communicating with a lower end of the bore 14. The housing 12 is cylindrical in shape and composed of a suitable material such as steel.

The detonator 10 also includes a header 18 being cylindrical in shape and mounted to the housing 12 within the recess 16 at the lower end thereof. The header 18 is composed of suitable electrical insulative material and supports an electrical ignition device 20 in the form of a pair of spaced pins or electrodes 22. The electrodes 22 are exposed at their upper ends facing the housing bore 14 and project from the header 18 at their lower ends for connection to suitable electrical components (not shown) for activating the detonator. At their exposed upper ends, the electrodes are interconnected by a resistively-heated bridgewire 24.

The housing bore 14 is loaded with a column of explosive 26, namely a charge of CP, and after which it is closed at its upper end by a circular closure disc 28, suitably attached such as by welding to the housing upper end about the opening to the bore 14. The closure disc 28 is composed of steel material.

The explosive CP column 26 is commonly loaded into the housing bore 14 in a series of increments, being represented by the dashed lines, such that the length-to-diameter ratio of each increment is one-half. The two charge increments 26A and 26B closest to the resistive bridgewire 24, called the ignition region 30, are typically loaded at 25 to 40 kpsi, whereas the remainder of the charge increments 26C–26F, called the transition region 32, are loaded at 10 kpsi.

The higher loading pressure of the explosive column 26 in the ignition region 30 ensures powder-to-bridgewire contact and thereby promotes ignition reliability. The lower loading pressure of the explosive column 26 in the transition region 32 permits desired gas flow through the column and thereby promotes the desired deflagration-to-detonation transition (DDT). Reduced density of the powder in the transition region 32 resulting from low loading pressure is required to yield reliable DDT. Prior work has shown that increased loading pressure increases density, decreases gas permeability, and decreases the pore size distribution. The results imply that larger pores dominate gas flow processes leading to DDT.

While the detonator 10 having the above-described structure and explosive charge composition is highly reliable, and while recognizing that CP provides some safety advantages over the previously-used primary explosives, nonetheless CP is not bonfire safe. The autoignition temperature of CP is approximately 280 degrees C, and oven tests with an all-CP detonator have yielded deflagration alone or DDT at heating rates of 2.4 and 15.8 degrees C/minute, respectively. Since postulated bonfire scenarios provide a temperature in excess of 1000 degrees C and heating rates approaching 200 degrees C/minute, an all-CP detonator cannot meet such requirements.

The present invention recognizes that improved safety against bonfire hazard can be attained by the specific selection and tailoring of the energetic materials making up the column of explosive 26.

Bonfire-Safe Low-Voltage Detonator

Turning now to FIG. 2, there is schematically shown the detonator portion which has been modified in accordance with the principles of the present invention in order to provide a reliable, low-voltage detonator 10A with intrinsic bonfire protection. The structural makeup of the detonator 10A is the same as the prior art detonator 10 and so the same reference numerals are used to identify identical parts. It is the composition and layering of a column of explosive 34 in the low-voltage detonator 10A that renders it bonfire-safe and thus different from the prior art bonfire-sensitive low-voltage detonator 10. In its basic makeup, the composition of the column of explosive 34 in the low-voltage detonator 10A is selected and layered to include, within the bore 14 of the housing 12 of the detonator, a first layer 36 of an explosive charge of CP, or a primary explosive such as lead azide or lead styphnate, and a second layer 38 of a secondary organic explosive charge, such as PETN and preferably coarse Type 1, having a degradation temperature which is lower than an autoignition temperature of the explosive charge of the first layer 36.

More particularly, the first layer 36 of the explosive column 34 is composed of a pair of increments 36A, 36B disposed in the bore 14 of the detonator housing 12 in an ignition region 40 of the explosive column 34 and adjacent to and in contact with the bridgewire 24 of the electrical ignition device 20 at one end of the bore 14. The second layer 38 of the explosive column 34 is composed of a plurality of increments 38A–38D, preferably four in number, disposed in the housing bore 14 in a transition region 42 of the explosive column 34 next to and in contact with the first layer 36 on a side opposite from the ignition device 20.

The first layer 36 is loaded under a sufficient high pressure, 25 to 40 kpsi, to achieve ignition, whereas the second layer 38 is loaded under a sufficient low pressure, about 10 kpsi, to allow occurrence of DDT. Each increment 36A–36B and 38A–38D of the first and second layers 36, 38 has an axial length-to-diameter ratio of one-half.

It is seen, therefore, that the first layer 36 of CP in the ignition region 40 provides reliable ignition and sufficient output to yield satisfactory transition to detonation in the second layer 38 of PETN in the transition region 42. The low temperature stability (melting point) of PETN relative to that (autoignition temperature) of CP (approximately 100 degrees C versus approximately 280 degrees C) allows degradation of the detonator 10A in a thermal environment prior to ignition of the CP, thereby resulting in a reliable bonfire-safe low-voltage detonator. Degradation of the PETN may be in form of physical damage to the detonator (from generated gas pressure), or termination of the existence of a DDT column before the CP ignites. Primary explosives, such as lead azide or lead styphnate, though less preferred than CP, have autoignition temperatures much higher than the degradation temperature for PETN and thus may also be used with PETN to provide bonfire safety.

Test Results

The design of the detonator of the present invention to provide possible improvements in bonfire safety thus simply involves replacing the CP with PETN in the DDT region. CP is retained in the ignition region because of its proven history of bridgewire ignition reliability, as well as the long history of ignition failures associated with organic explosives such as PETN. Therefore, in the normal firing mode, ignition reliability is based on that achieved for all-CP detonators. Safety advantages of all-CP detonators, relative to those containing primary explosives, still apply. The inclusion of the PETN, however, provides the improvement in bonfire safety. Loading of the PETN column must be such as to allow DDT to occur when fired normally, given ignition by the CP-loaded ignition region.

Prior work with CP has shown that the pore-size distribution in the DDT column controls growth to detonation. The distribution can be affected by particle size and loading pressure. Consequently, PETN particle size was varied and loading pressure was arbitrarily chosen to be identical with that used for CP DDT columns. Only unclassified, commercially available (Mound Facility) grades of PETN were considered, namely, Type 1, B/N A-1567 (coarse) and Type 12 (U), B/N ER-7549 (fine). These were selected to cover the widest possible range of particle size. Surface area measurements (BET method with krypton) were 0.29 and 1.54 $m^2/gm$, respectively. CP development lot EL-58636 was used.

Three groups of detonators were fabricated. All had identical ignition region loadings of CP in two increments at 40 kpsi (1.8 $Mg/m^3$). The four-increment, 10 kpsi DDT columns contained Type 1 PETN (S/N 1369–1383) (1.6 $Mg/m^3$), Type 12 (U) PETN (S/N 1384–1394) (1.5 $Mg/m^3$) or CP (S/N 1362–1368) (1.6 $Mg/m^3$). The last group provided all-CP detonators for comparison purposes. Electrothermal response measurements for the three groups yielded gamma values (a measure of heat transfer from the bridgewire to its environment) of $6.38 \pm 2.33$, $9.35 \pm 2.01$, and $8.51 \pm 1.43$ mW/K, respectively. Based on prior work, these values imply reliable ignition conditions.

Prior to performing bonfire testing, it was necessary to verify that the PETN-containing detonators would function as detonators when fired via the bridgewire. Detonators were fired with a high-current (approximately 50 amperes) pulse, and output was characterized by monitoring the velocity of the resultant flyer by means of a VISAR.

Bonfire testing required particular attention. The high temperature limit of a bonfire was not relevant because the detonators would function by the considerably lower autoignition temperature of CP. Consequently, control of the heating rate was of principal importance. Since a slow heating rate would provide more time for degrading PETN to physically damage the device, the probability of growth to detonation was expected to increase with increasing heating rate. In order to achieve heating rates approaching 200 degrees C/minute, it was necessary to use radiant heat facilities rather than electric furnaces.

In the test assembly used, the detonator was contained within a steel tube and steel end plates in order to prevent damage to the radiant lamps from shrapnel. The detonator was located in a vertical orientation with the output end in contact with a thin foil switch and a steel dent block. The temperature of the detonator was monitored via a chromel-alumel thermocouple welded near the middle of the detonator. A triangular plate fitted over three posts and contacted the ignition end of the detonator; three screws were tightened to assemble the detonator in its proper location. The two leads from the detonator were shorted together. The foil switch provided the function time of the detonator so that the temperature at function could be clearly evaluated. A thermocouple on the outside of the steel container was used for calibration and control purposes. The dent block was included to evaluate output of the detonator.

The appearance of the fired detonators in X-radiographs provided the basis for evaluating growth to detonation. The condition of the inner diameter of the detonators allowed classifying them as (a) having undergone DDT, (b) not having undergone DDT, and (c) having undergone DDT in the reverse direction.

Results were obtained on VISAR and bonfire tests and on chemical compatibility. VISAR tests were initially performed to ascertain that the detonators did undergo DDT when initiated by a hot bridgewire. Triplicate tests performed with each of the two types of PETN yielded reproducible results. Detonators containing the coarse Type 1 PETN yielded a detonating output, whereas those containing the fine Type 12 (U) PETN did not. This indicates that fine particle PETN can diminish bed permeability sufficiently to prohibit growth to detonation. Since the objective of the investigation was to develop a detonator with improved bonfire safety, subsequent bonfire testing excluded detonators containing Type 12 (U) PETN.

Only one of the all-CP detonators was evaluated with the VISAR. The terminal velocity of 2.7 mm/microsecond was comparable to results obtained from at least six tests of all-CP detonators in various prior lots. The greater terminal velocity achieved with the CP/PETN Type 1 device (approximately 3.2 mm/microsecond) implies that such a device provides greater margin for initiation of acceptor explosives and that it may be useful for the initiation of less sensitive acceptor explosives.

A series of bonfire simulation tests were performed at a radiant heat facility. Two tests performed with all-CP detonators yielded DDT with a heating rate of 90 degrees C/minute, but non-DDT at 20 degrees C/minute. Three tests performed with CP/PETN Type 1 detonators yielded non-DDT for heating rates of 50, 70, and 160 degrees C/minute. One test was performed with the same type detonator in which the test assembly was inverted and the heating rate was increased to 290 degrees C/minute; this yielded reverse DDT.

The heating rate threshold for DDT in the all-CP detonators was not accurately determined. Clearly, it is between 20 and 90 degrees C/minute. Prior work suggests it is close to the lower value. The fact that the CP/PETN Type 1 detonator did not undergo DDT at 160 degrees C/minute shows that a significant improvement in bonfire safety was achieved. The test of a heating rate of 290 degrees C/minute was intended as a great overtest and the arrangement was inverted to address concern regarding sensitivity to orientation. The implications of reverse DDT are uncertain. While it seems likely that the flyer in such a condition would be of considerably lower velocity than that achieved from a detonating source, the output of the detonator is poorly defined. Similarly, it should be recognized that even when non-DDT occurs, the velocity of a flyer driven by a deflagrating material may be great enough to initiate an acceptor explosive.

These results imply the CP/PETN Type 1 detonator is attractive because it yields an improvement in bonfire safety. The extent of that improvement, as measured by heating rate threshold for DDT and reliability, requires additional work.

Chemical compatibility between CP and PETN was examined via differential scanning calorimetry (DSC). A 50/50 mixture of the two powders was heated at 10 degrees C/minute. The resultant DSC trace yielded a composite of those achieved separately for the two constituents, i.e., neither exotherms nor endotherms were displaced in temperature or shape. Since potential chemical incompatibilities are frequently reflected in such displacements, the result implies that no chemical incompatibility exists.

In summary, the tests indicate that a CP/PETN Type 1 detonator provides improved bonfire safety relative to an all-CP detonator. In addition, the output of the former is greater than that of the latter which implies it can be used with less sensitive acceptor explosives. Preliminary measurements show an absence of chemical compatibility problems between CP and PETN.

Recapitulation

In summary, the present invention is based on the use of layered explosives within the detonator. The desired safety advantage is derived from the intrinsic properties of the explosives themselves. This is a major difference from other detonators in which safety must be achieved through the use of auxiliary parts. No prior detonators are known which furnish improved safety through selection and layering of the explosive materials themselves. Since the present invention addresses safety within the powder column itself, provision of some external protective device is rendered unnecessary. The present invention yields a primary level of safety improvement, i.e., if the powder column is intrinsically safe, the detonator is inherently safe.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. A bonfire safe detonator having a housing with a bore therein, a header supported by said housing and mounting an electrical ignition device in communication with and adjacent to an end of said housing bore, and a column of explosive comprising:

(a) a first layer of an explosive charge of CP disposed in said housing bore in an ignition region of said explosive column adjacent to and in contact with said ignition device; and (b) a second layer of a secondary organic explosive charge disposed in said housing bore in a transition region of said explosive column and on a side of said first layer opposite from said ignition device and in contact with said first layer;

(c) said organic explosive charge of said second layer having a degradation temperature which is lower than an autoignition temperature of said CP explosive charge of said first layer.

2. The detonator as recited in claim 1, wherein said organic explosive charge in PETN.

3. The detonator as recited in claim 1, wherein said first layer is loaded under a pressure of from 25 to 40 kpsi.

4. The detonator as recited in claim 1, wherein said second layer is loaded under a pressure of about 10 kpsi.

5. The detonator as recited in claim 1, wherein said first and second layers are loaded in increments having an axial length-to-diameter ratio of one-half.

6. The detonator as recited in claim 1, wherein said first layer is loaded in a pair of increments each having an axial length-to-diameter ratio of one-half.

7. The detonator as recited in claim 1, wherein said second layer is loaded in more than a pair of increments each having an axial length-to-diameter ratio of one-half.

8. A bonfire safe detonator having a housing with a bore therein, a header supported by said housing and mounting an electrical ignition device in communication with and adjacent to an end of said housing bore, and a column of explosive comprising:

a first layer of an explosive charge of CP disposed in said housing bore in an ignition region of said explosive column adjacent to and in contact with said ignition device; and a second layer of an explosive charge of PETN disposed in said housing bore in a transition region of said explosive column and on a side of said first layer opposite from said ignition device and in contact with said first layer;

(c) said first layer having been loaded under a pressure of from 25 to 40 kpsi and said second layer having been loaded under a pressure of about 10 kpsi.

9. The detonator as recited in claim 8, wherein said second layer of PETN is coarse Type 1.

* * * * *